United States Patent [19]

Arnold

[11] Patent Number: 4,520,761

[45] Date of Patent: Jun. 4, 1985

[54] DIRECT CONTACT WATER HEATER

[75] Inventor: Gerald D. Arnold, Huddersfield, England

[73] Assignee: John Thurley Limited, Harogate, England

[21] Appl. No.: 496,508

[22] Filed: May 20, 1983

[30] Foreign Application Priority Data

May 20, 1982 [GB] United Kingdom ..... 8214681

[51] Int. Cl.[3] ..... F22B 1/02

[52] U.S. Cl. ..... 122/31 R; 110/215; 110/234; 122/5.5 A; 261/22; 261/147

[58] Field of Search ..... 122/5.5 A, 31 R; 60/641, 649, 670; 110/215, 234; 431/208; 261/22, 147, 148

[56] References Cited

U.S. PATENT DOCUMENTS

| | | | |
|---|---|---|---|
| 2,838,135 | 6/1958 | Pilo et al. . | |
| 3,404,512 | 10/1968 | Tomany | 261/22 |
| 3,716,339 | 2/1973 | Shigaki et al. | 110/215 |
| 3,869,242 | 3/1975 | Schladitz | 431/208 |
| 3,954,381 | 5/1976 | Marecaux | 110/215 |
| 4,084,379 | 4/1978 | Schwartzman | 122/31 R |
| 4,164,202 | 8/1979 | Lockett, Jr. | 122/31 R |
| 4,245,569 | 1/1981 | Fallon, III | 110/215 |

FOREIGN PATENT DOCUMENTS

| | | | |
|---|---|---|---|
| 729924 | 8/1932 | France | 122/31 |
| 2114855 | 6/1972 | France . | |

*Primary Examiner*—Edward G. Favors
*Assistant Examiner*—Steven E. Warner
*Attorney, Agent, or Firm*—Brooks & Kushman

[57] ABSTRACT

This invention relates to an improvement in direct contact water heaters and in methods of effecting heat exchange between hot gas and cold water. In a typical direct contact water heater cold water is sprayed downwards within a main chamber where it meets hot gas passing upwardly in a counter-current fashion. A direct contact water heater according to this invention includes an antechamber through which the hot gas is passed before entering the main chamber. The hot gas passing upwardly in a counter current fashion to hot water which is at a temperature higher than the dew point of the gas raises the dew point of the hot gas before it enters the main chamber so that the cold water entering the main chamber is heated in an efficient manner to higher temperatures than could previously be effected.

6 Claims, 3 Drawing Figures

DIRECT CONTACT WATER HEATER

This invention relates to an improvement in direct contact water heaters.

Direct contact water heaters are, as the name suggests, water heaters in which the temperature of the water is raised by contact with a hot gas without the imposition of an impermeable barrier (such as a heat exchanger wall) between the gas and the water. In such heaters the gas and water are allowed to mix and water can pass from the aqueous phase into the gas stream or vice-versa according to the conditions obtaining within the device.

Such heaters often employ hot gases which may be waste gases from a boiler, dryer, turbine or other item of industrial equipment. The gases will normally contain water vapour and, indeed, a considerable proportion of the heat transferred from the gases to the water is usually obtained from the latent heat of condensation of entrained water vapor within the gases.

In a typical direct contact water heater, cold water is sprayed downward within a container where it meets the hot gas passing upwardly in a counter-current fashion. Considering the case where the water at the bottom of the device has been heated to a temperature in excess of the dew point of the incoming gas, it will be apparent that water will evaporate into the gas phase until such a point as the gas becomes saturated (that is its actual temperature and dew point coincide) and the gas will then remain in a saturated condition as it leaves the device. If, on the other hand, the temperature of the water where the inlet gas first meets it is below the dew point temperature of the gas, water vapor will condense from the gas into the liquid water stream thereby de-humidifying the gas. As the gas continues its upward journey meeting progressively colder water the water vapor will continue to condense, de-humidifying the gas further, until the gas finally leaves the heater in an unsaturated condition.

Since a saturated gas must contain a greater amount of heat than an unsaturated gas of the same temperature, it is desirable, for maximum efficiency, to operate this kind of heater such that the highest water temperature encountered by the gas is below due point of the gas. Thus, the maximum temperature of conventional direct contact water heaters has been limited by the dew point of the available heating gas, which is commonly in the range of 55° to 60° C.

The invention seeks to provide an improved direct contact water heater in which the water can be heated in an efficient manner to temperatures higher than the dew point of the incoming heating gas.

According to the present invention there is provided a direct contact water heater which comprises a chamber in which, in use, cold water may be brought into contact with hot gas and an ante-chamber in which, in use, the hot gas can be brought into contact with hot water having a temperature above the initial dew point of the gas whereby to increase the dew point of the gas before it is passed into the main chamber.

The antechamber may be similar to the main chamber in that it contains spraying means for spraying the hot water in a counter-current fashion to the passage of the incoming hot gas. The hot water is preferably connected at the base of the ante-chamber and re-circulated through the spraying means. In this manner it is maintained at a temperature above the dew point of the incoming gas and water constantly evaporates into the gas stream thereby increasing the dew point thereof. In order to maintain the level of water within the anti-chamber there may be provided a reservoir and flow control means, such as a ball-cock valve, which may be fed either with cold water, or preferably, with hot water from the main chamber of the heater.

The main chamber of the heater will resemble the main chamber of a normal direct contact water heater in construction but, owing to the presence of the ante-chamber, the input gas to the main chamber will have a considerably higher dew point than the normally available input gas and it is therefore capable of producing water heated to a correspondingly higher temperature in an effecient manner.

Two embodiments in accordance with the invention will be described further, by way of example, with reference to the accompanying drawings, in which.

Figure 1:
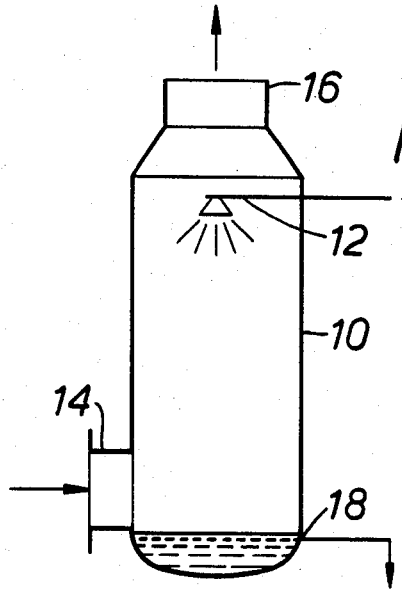
FIG. 1 is a diagramatic view of a conventional direct contact water heater.

Referring firstly to FIG. 1, it can be seen that a conventional heater comprises a chamber 10 having cold water inlet spray means 12 for spraying water down the chamber 10. The chamber may contain a bed of Raschig or Pall rings, a bubble cap tray system, or other known devices for increasing the contact area between the water and the heating gas. Hot gas is passed in a counter-current fashion through the chamber 10 from an inlet 14 towards the base thereof and spent gas is exhausted from the chamber through an outlet 16. Hot water may be drawn off from the base of the chamber 10 at outlet 18. As previously explained, for maximum efficiency, the device should be operated so that the temperature of the hot water at outlet 18 is below the dew point of the incoming hot gas at inlet 14.

Figure 2:
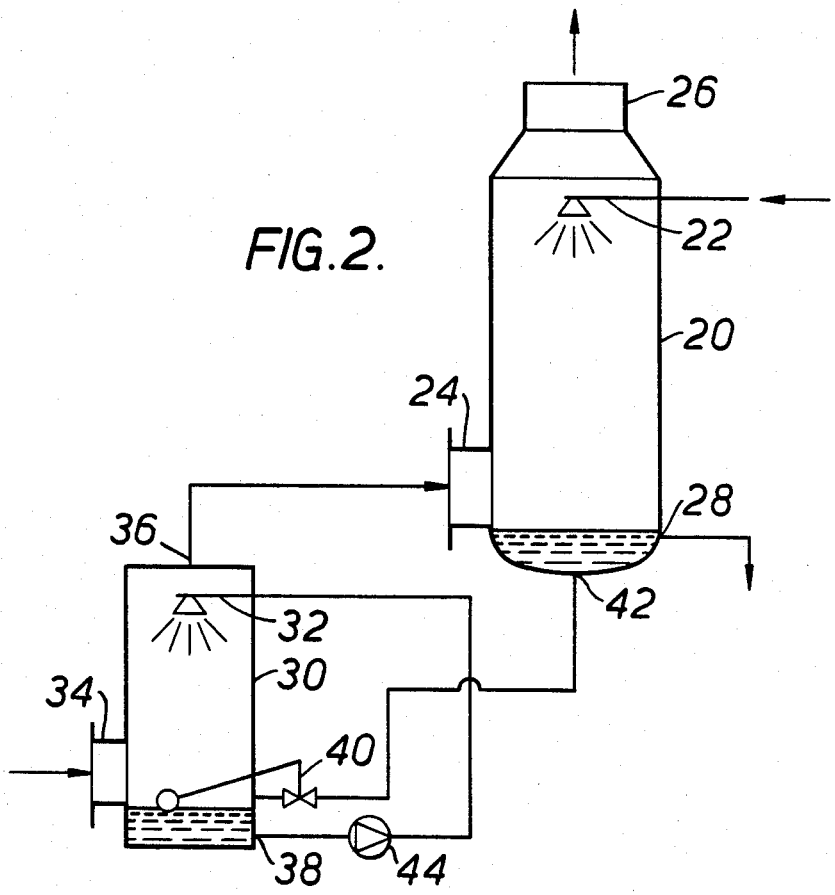
FIG. 2 is a diagrammatic view of a first example of a heater constructed in accordance with the present invention.

Referring now to FIG. 2, it can be seen that a device constructed in accordance with the present invention comprises a main chamber 20 similar to the conventional water heater illustrated in FIG. 1. The chamber 20 has a cold water inlet and spray means 22 and may be packed with known devices for increasing the contact between the sprayed water and the hot gas. The gas is passed into the chamber 20 through an inlet 24 and exits through an outlet 26. Hot water may be drawn off at the base of the chamber 20 at a hot water outlet 28.

The device in accordance with the invention is, however, modified in that it is provided with an antechamber 30 which contains water inlet and spray means 32, a hot gas inlet 34, a gas outlet 36. An outlet 38 is also provided for re-cycling hot water. The level of water within the chamber 30 is controlled by a ball-cock valve 40 and additional water to maintain the level is obtained from a secondary outlet 42 at the base of the main chamber 20 and circulation pump 44 is provided between the hot water re-circulation outlet 38 and the spray means 32.

The device of FIG. 2 operates as follows. Hot gas from a burner, boiler, furnace or other industrial equipment will typically have a dew point in the range 55° to 70° C. and, except with gases emanating from drying equipment or the like, would generally be towards the lower end of this range, namely 55° to 60° C. It will be appreciated that the actual temperature of the gas may be, and generally will be, considerably in excess of its dew point. Such hot gas is taken to the inlet 34 of the antechamber 30 where it is brought into initmate contact with water from the spray 32. Since the water sprayed in the antechamber 30 is re-circulated the temperature will very soon rise until it exceeds the dew point of the incoming hot gas and it will therefore evaporate adding to the water vapor content of the gas and thus raising its dew point. The gas which therefore leaves the exit 36 to enter the main chamber 20 via inlet 24 will therefore have a considerably higher dew point than the gas originally supplied to the antechamber. Thus, the water sprayed by means of spray means 22 within the main chamber 20 may be heated efficiently to a higher temperature, corresponding to the higher dew point of the gas being input to the main chamber 20 and thus the water collected at outlet 28 will be hotter than would otherwise be possible with the preservation of good efficiency. The water level within the ante-chamber 30 is maintained by means of a ball-cock valve 40 and a bleed outlet 42 from the main chamber 20 to replace losses through evaporation into the gas stream passing through the antechamber.

Figure 3:
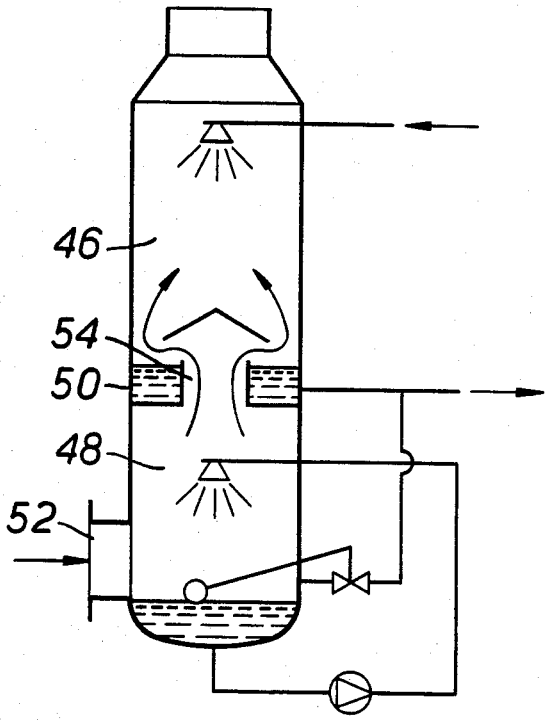
FIG. 3 is a diagramatic view of a second example of a heater constructed in accordance with the present invention.

The amount by which the dew point of the hot gas can be raised will depend entirely upon its initial temperature. The higher its initial temperature the more heat is available to evaporate the primary water, and thus the higher the temperature to which the water within the main chamber 20 may be heated. The heater shown in FIG. 3 is one in which a vessel 50 includes an upper main chamber 46 and a lower antechamber 48. Hot gas enters the antechamber 48 through inlet 52 and passes upwards through the antechamber 48 through opening 54 into upper chamber 46. Hot water is sprayed downwards in the antechamber 48. The temperature of the hot water is higher than the dew point of the gas. This increases the dew point of the hot gas passing upwards into the main chamber 46. Cold water is sprayed downwards in the main chamber 46 and is heated by the hot gas and then caught in reservoirs 56 at the base of the main chamber 46. Hot water from 56 is used to maintain the water level in lower chamber 48.

I claim:

1. A direct contact water heater comprising: a main chamber including a hot gas inlet and cold water feed means to feed cold water in said main chamber, whereby to effect direct contact heat exchange between said hot gas and said cold water, the improvement wherein said heater also includes an antechamber having a hot gas outlet coupled to said inlet of said main chamber, and including means to input hot gas into said antechamber and hot water feed means to feed hot water into said antechamber, the temperature of said hot water being higher than the dew point of the hot gas input into the antechamber whereby the dew point of the hot gas outputted by the antechamber is increased and whereby the cold water is heated to a temperature higher than the dew point of the hot gas fed into the antechamber, said antechamber including a hot water outlet coupled to said hot water feed means whereby said hot water is recycled through said antechamber, and a reservoir, the level of which is maintained by flow-control means, said main chamber including a heated water outlet, said outlet being coupled to said flow-control means to maintain the level in said reservoir in the antechamber.

2. A direct contact water heater in accordance with claim 1 wherein said flow-control means comprises a ball-cock valve.

3. A direct contact water heater in accordance with claim 1, wherein said main chamber comprises a first vessel and said antechamber comprises a second vessel.

4. A direct contact water heater in accordance with claim 1, including a vessel containing the main chamber and the antechamber.

5. A direct contact water heater in accordance with claim 4 in which the main chamber forms the upper chamber of the vessel and the antechamber forms the lower chamber of the vessel.

6. A direct contact water heater in accordance with claim 1, wherein said hot water feed means comprises first spraying means, said cold water feed means comprises second spraying means, said means to feed hot gas into said antechamber feeds gas in a first direction, and said means to feed hot gas into said main chamber feeds gas in a second direction, said first spraying means sprays hot water in a third direction opposite to said first direction, and said second spraying means sprays cold water in a fourth direction opposite to the second direction.

* * * * *